US007710037B2

(12) United States Patent
Bae

(10) Patent No.: US 7,710,037 B2
(45) Date of Patent: May 4, 2010

(54) PLASMA DISPLAY PANEL

(75) Inventor: Joonwoon Bae, Gumi (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 12/162,275

(22) PCT Filed: Dec. 6, 2007

(86) PCT No.: PCT/KR2007/006326

§ 371 (c)(1),
(2), (4) Date: Jul. 25, 2008

(87) PCT Pub. No.: WO2008/069601

PCT Pub. Date: Jun. 12, 2008

(65) Prior Publication Data

US 2009/0021166 A1 Jan. 22, 2009

(30) Foreign Application Priority Data

Dec. 6, 2006 (KR) ..... 10-2006-0123387

(51) Int. Cl.
*H01J 17/49* (2006.01)

(52) U.S. Cl. ..... 313/585; 313/586

(58) Field of Classification Search ..... 313/582–587; 345/60; 315/169.1, 169.3
See application file for complete search history.

(56) References Cited

U.S. PATENT DOCUMENTS 6,118,214 A 9/2000 Marcotte ..... 313/582
2005/0099125 A1* 5/2005 Tachibana et al. ..... 313/585
2006/0001371 A1* 1/2006 Jang ..... 313/582
2006/0013171 A1 1/2006 Ahuja et al. ..... 370/338
2006/0163993 A1* 7/2006 Hwang ..... 313/292
2006/0226779 A1* 10/2006 Ahn ..... 313/583
2006/0232210 A1* 10/2006 Kim ..... 313/582

FOREIGN PATENT DOCUMENTS

JP 2006-286630 10/2006
KR 10-2005-0102390 A 10/2005
KR 10-2006-0104524 A 10/2006
KR 10-2006-0110121 A 10/2006

OTHER PUBLICATIONS

Korean Office Action dated Oct. 26, 2007.
International Search Report dated Mar. 14, 2008.

* cited by examiner

*Primary Examiner*—Joseph L Williams
*Assistant Examiner*—Brenitra M Lee
(74) *Attorney, Agent, or Firm*—KED & Associates, LLP

(57) ABSTRACT

A plasma display panel that can improve a driving efficiency by advancing a structure of at least one of a first electrode and a second electrode in a dummy area or a pad area is provided. The plasma display panel includes a front substrate in which a first electrode and a second electrode in parallel to each other are disposed, a rear substrate in which a third electrode intersecting the first electrode and the second electrode is disposed, and a barrier rib disposed between the front substrate and the rear substrate and for partitioning a discharge cell. At least one of the first electrode and the second electrode includes a plurality of line portions intersecting the third electrode in an active area, and two or more line portions of at least one of the first electrode and the second electrode are combined into one in a dummy area at the outer side of the active area.

19 Claims, 9 Drawing Sheets

[Fig. 1]
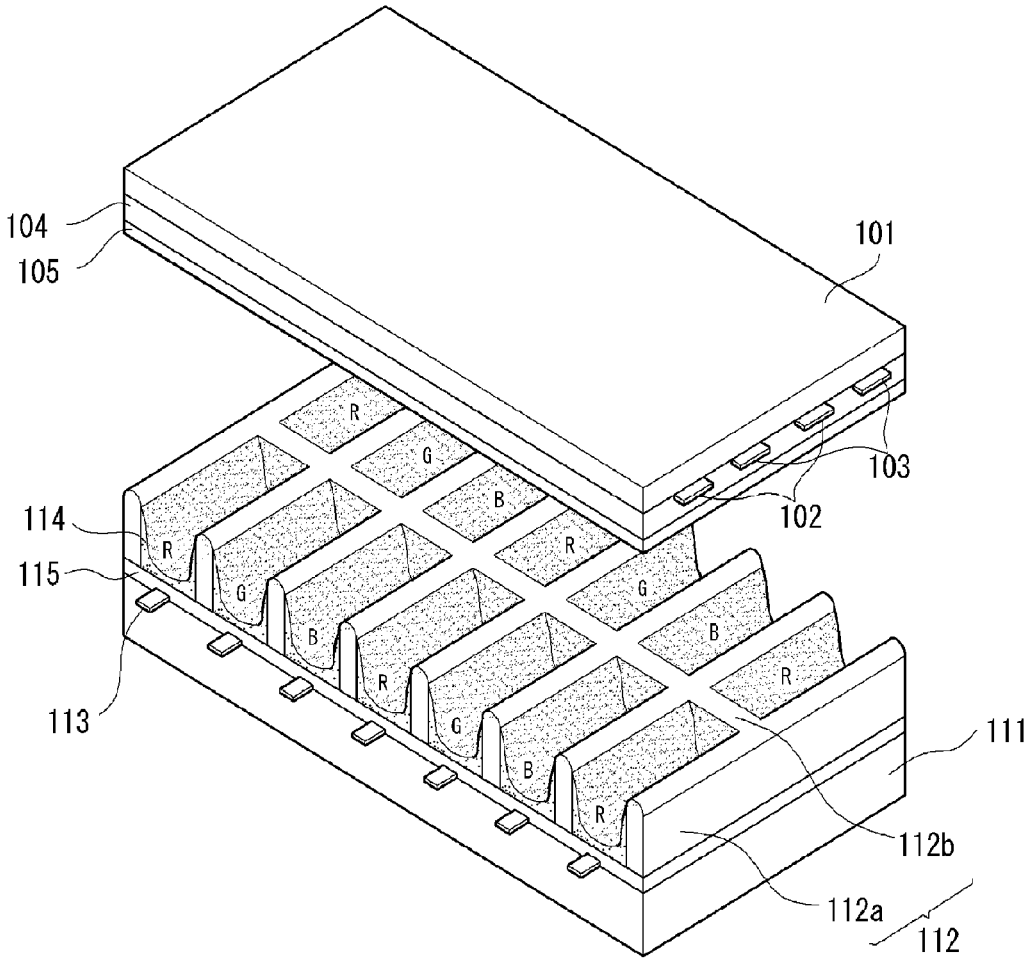
[Fig. 2]
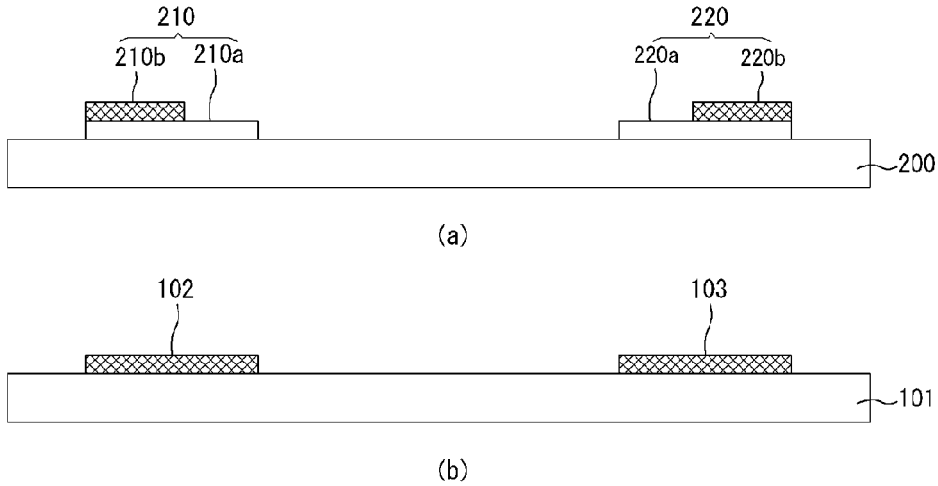

[Fig. 3]
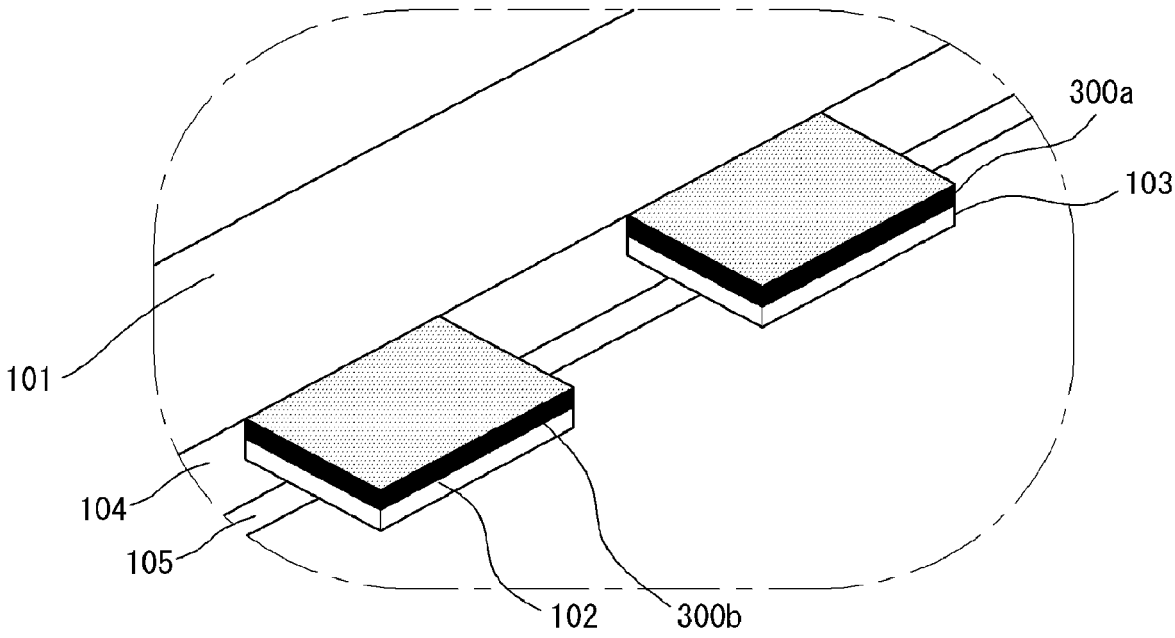

[Fig. 4]
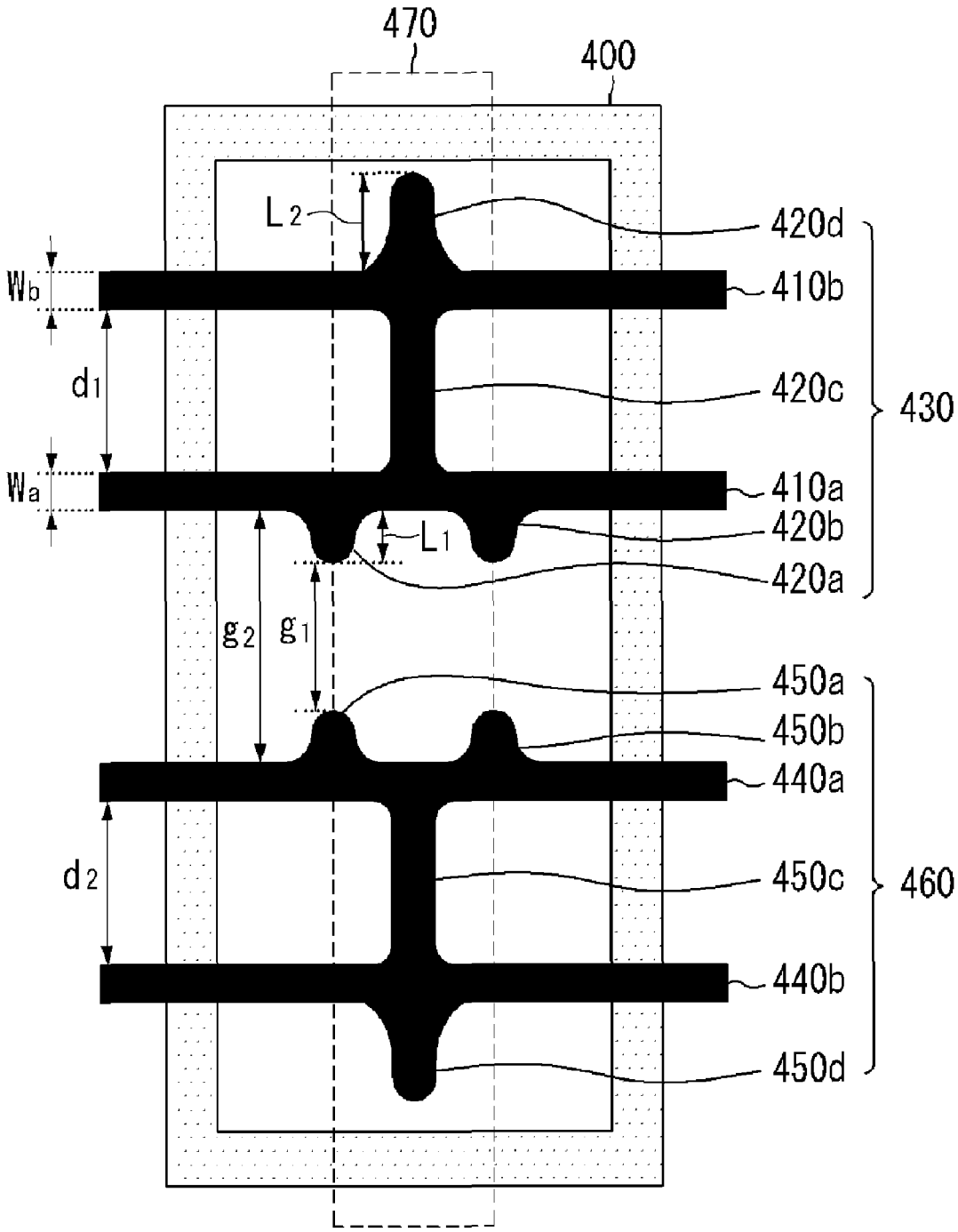

[Fig. 5]
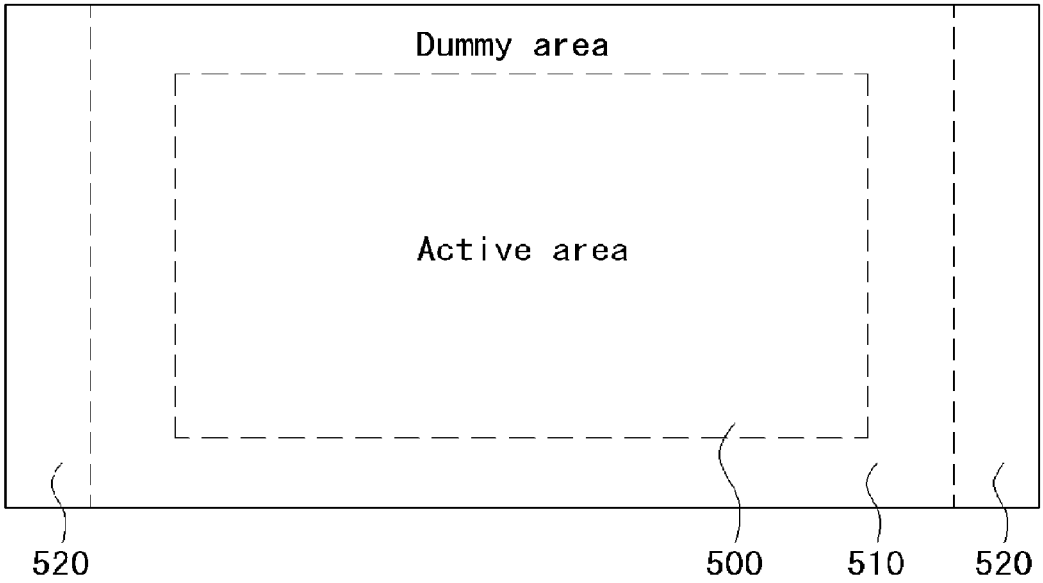
[Fig. 6]
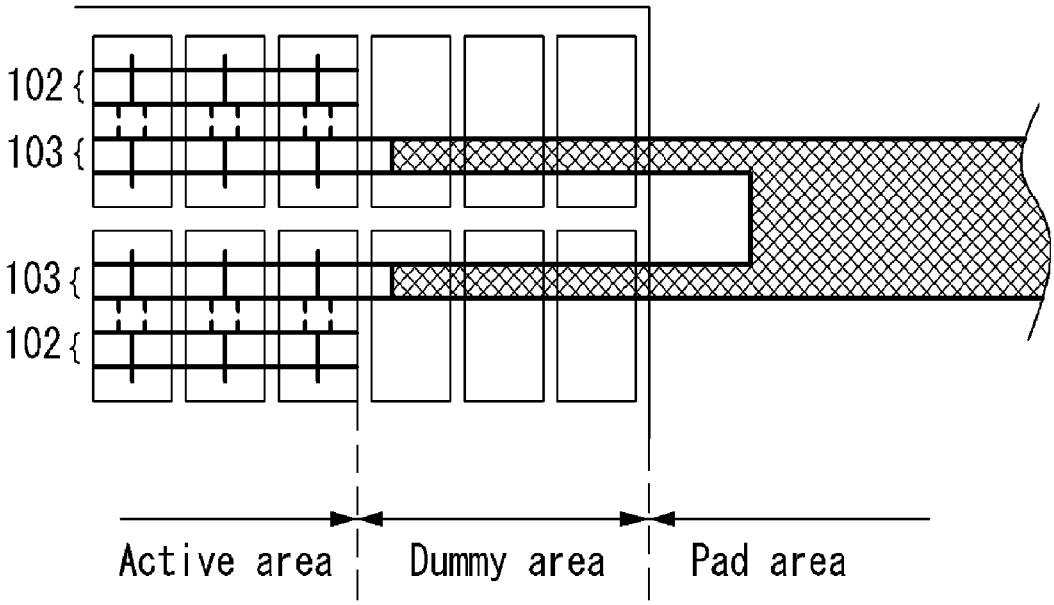

[Fig. 7]
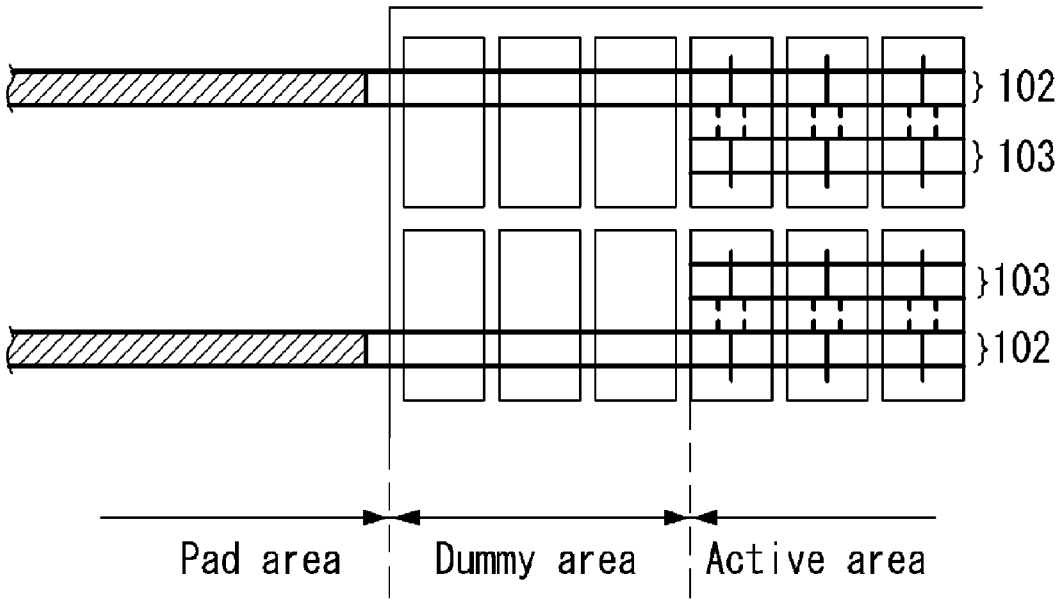

[Fig. 8]
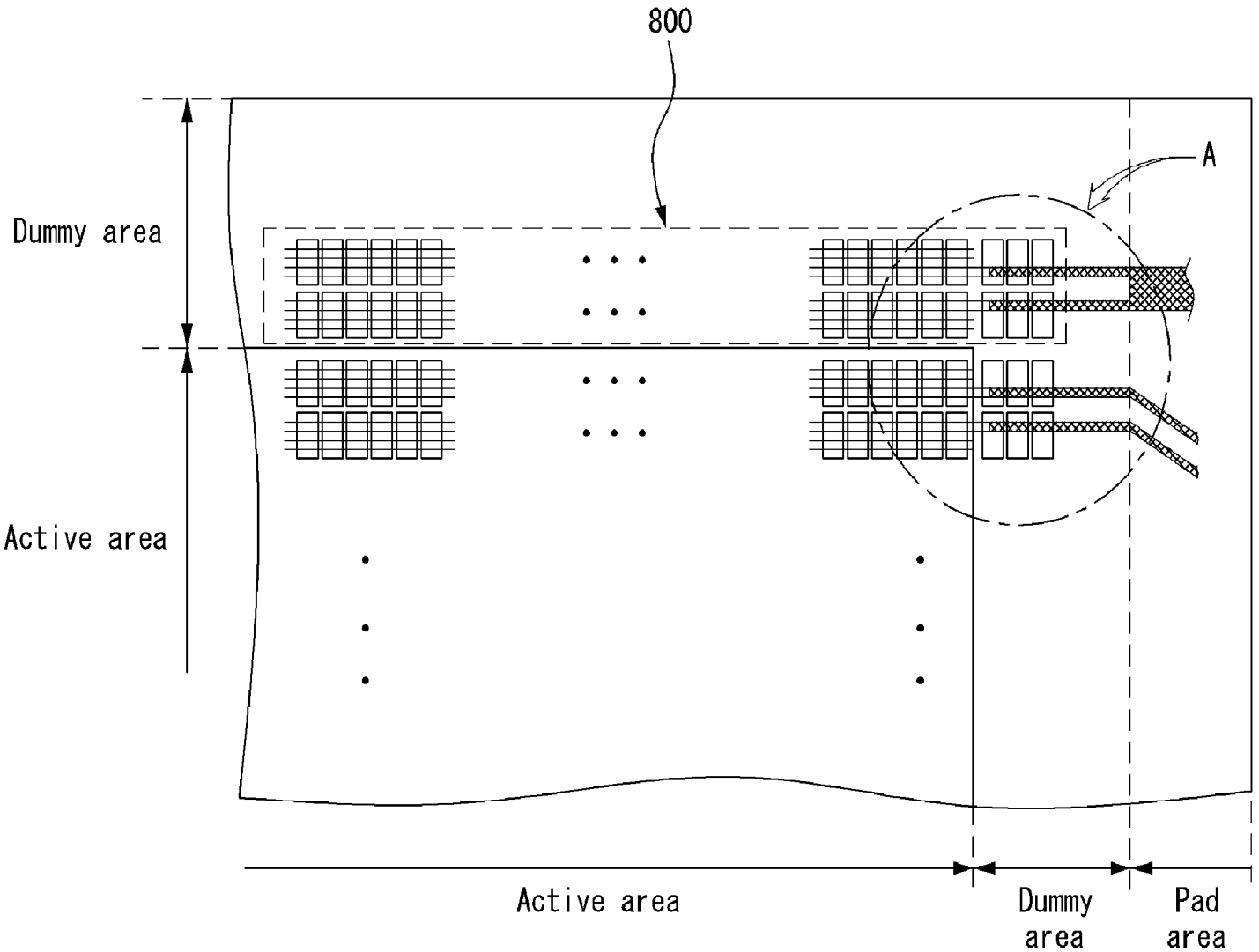

[Fig. 9]
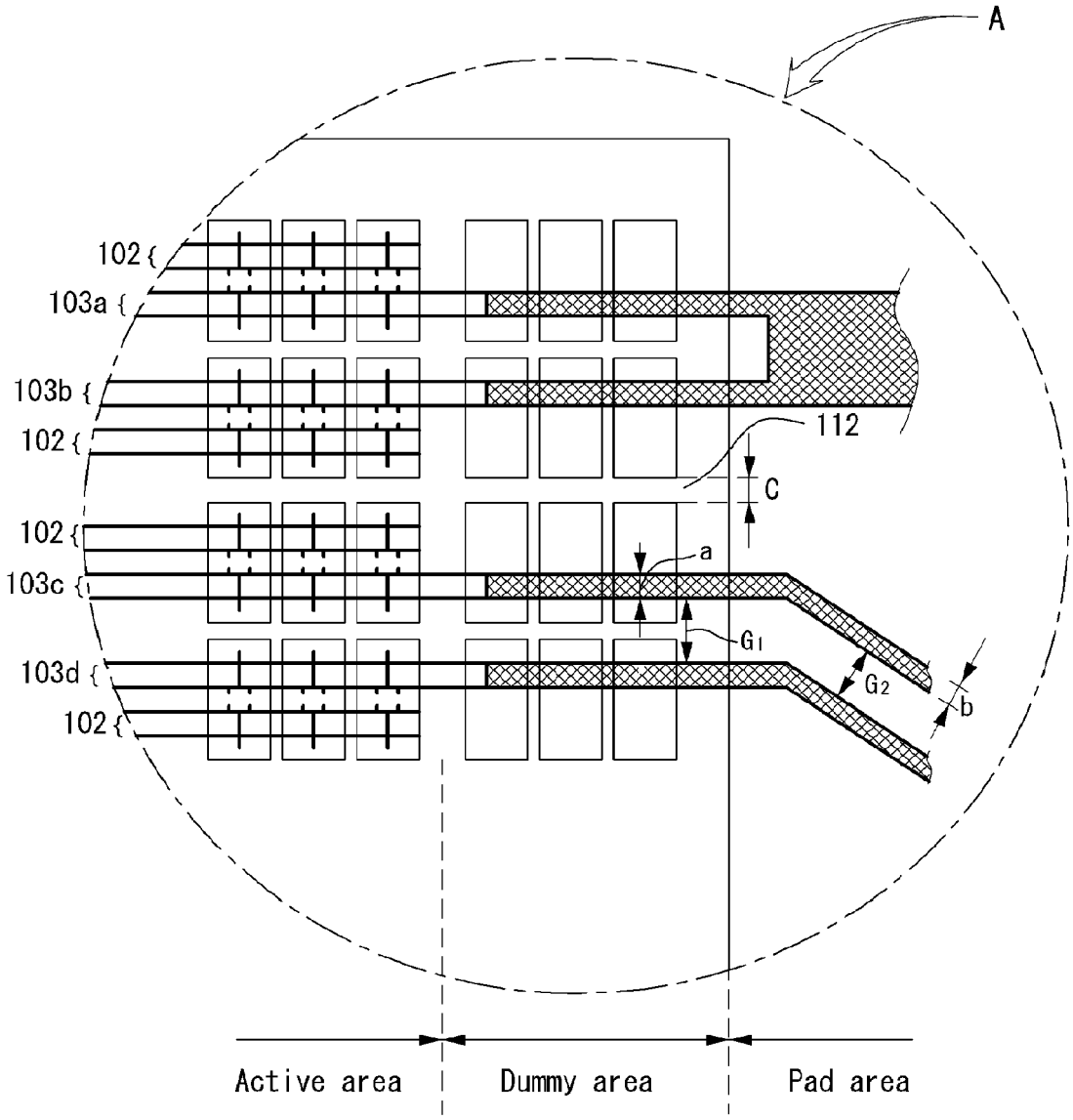

[Fig. 10]
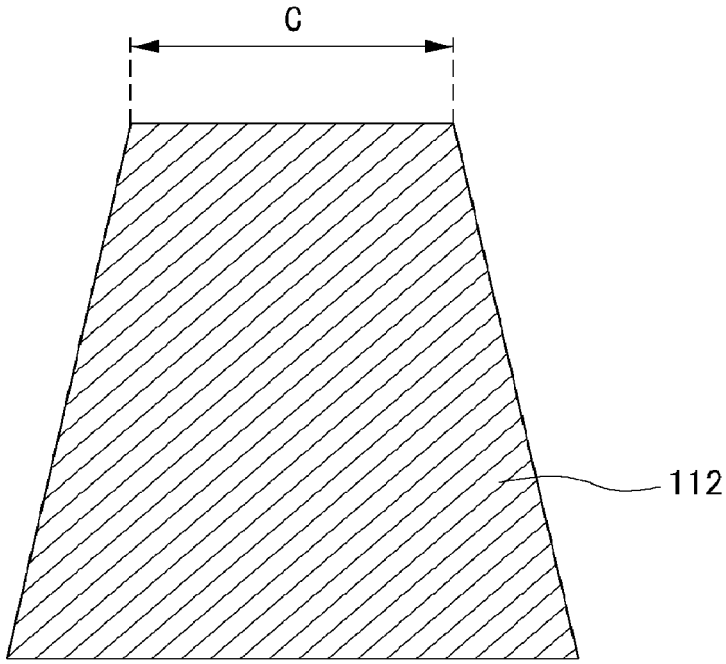
[Fig. 11]
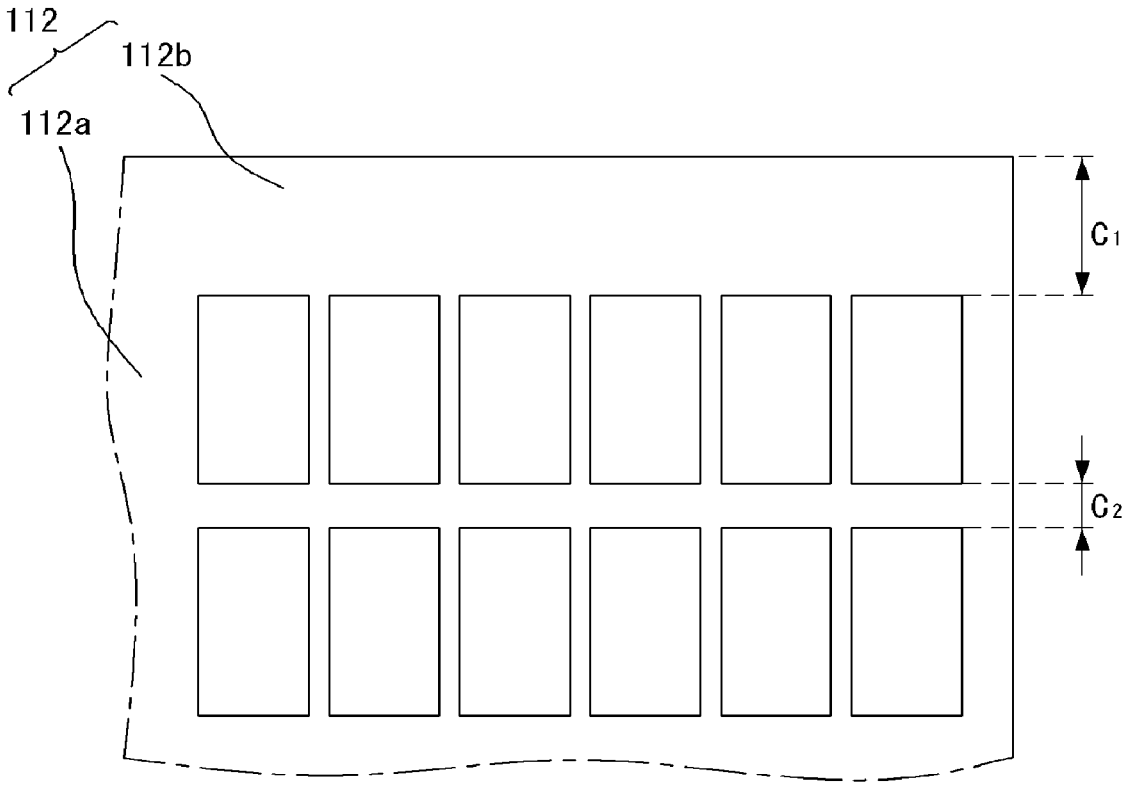

[Fig. 12]
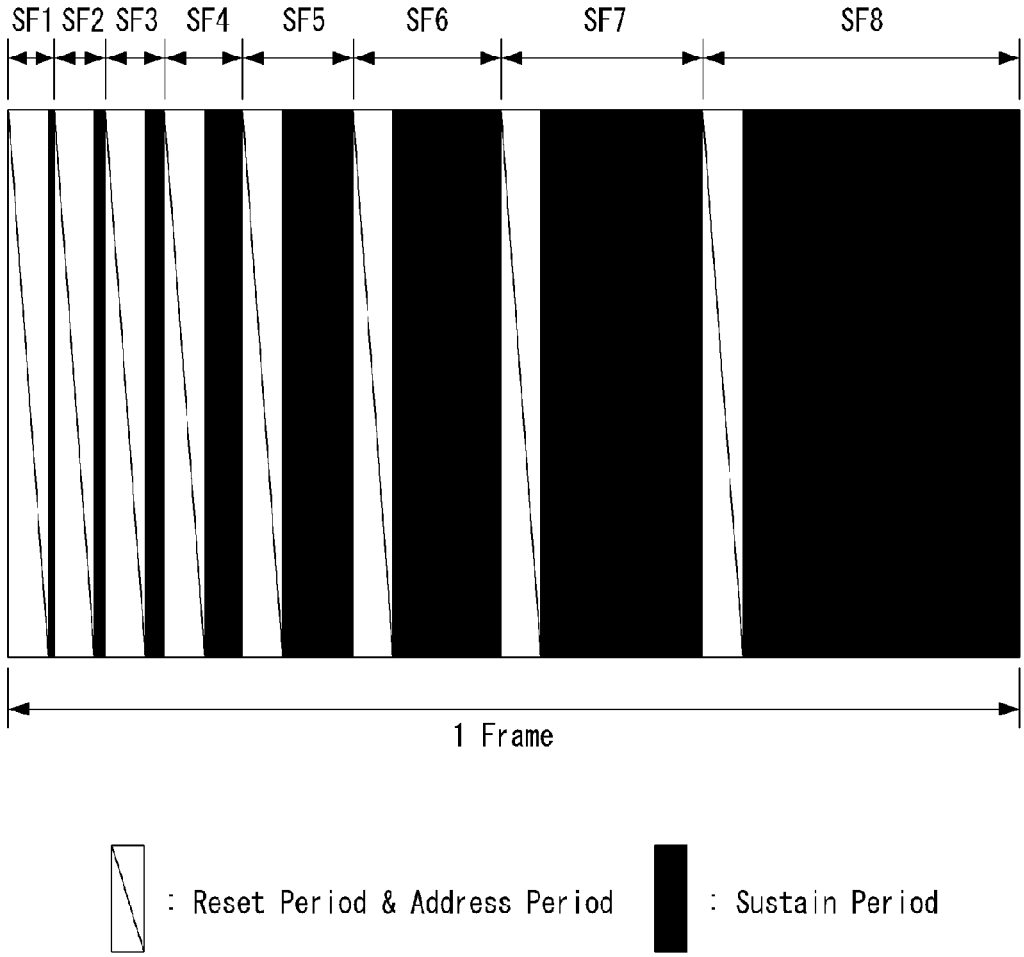

PLASMA DISPLAY PANEL

TECHNICAL FIELD

This document relates to a plasma display panel.

BACKGROUND ART

In general, in a plasma display panel, a phosphor layer is formed and a plurality of electrodes is formed within a discharge cell partitioned by barrier ribs.

A driving signal is supplied to the discharge cell through the electrode.

A discharge is generated by the supplied driving signal within the discharge cell. When a discharge is generated by the driving signal within the discharge cell, a discharge gas filled within the discharge cell generate vacuum ultraviolet rays, and the vacuum ultraviolet rays enable a phosphor formed within the discharge cell to emit light, thereby generating visible light. An image is displayed on a screen of the plasma display panel by the visible light.

DISCLOSURE OF INVENTION

Technical Problem

An aspect of this document is to provide a plasma display panel that can improve a driving efficiency by advancing a structure of at least one of a first electrode and a second electrode in a dummy area or a pad area.

Technical Solution

In one general aspect, a plasma display panel comprises: a front substrate in which a first electrode and a second electrode in parallel to each other are disposed; a rear substrate in which a third electrode intersecting the first electrode and the second electrode is disposed; and a barrier rib for partitioning a discharge cell between the front substrate and the rear substrate, wherein at least one of the first electrode and the second electrode comprises a plurality of line portions intersecting the third electrode in an active area, and two or more line portions of at least one of the first electrode and the second electrode in a dummy area at the outer side of the active area are combined into one.

The at least one of the first electrode and the second electrode may be a bus electrode.

The at least one of the first electrode and the second electrode may comprise at least one protruded portion protruded from the line portion.

The protruded portion may comprise at least one first protruded portion protruded in a first direction and at least one second protruded portion protruded in a second direction, which is a direction opposite to the first direction.

In the dummy area, any one of the first electrode and the second electrode may be omitted.

In a pad area at the outer side of the dummy area, two or more electrodes of at least one of the first electrode and the second electrode may be combined into one.

An advancing direction in the dummy area of two or more electrodes of at least one of the first electrode and the second electrode may be substantially equal to an advancing direction in a pad area at the outer side of the dummy area thereof.

An advancing direction in the dummy area of one or more electrode of the at least one of the first electrode and the second electrode may be different from that in the pad area thereof.

In the at least one of the first electrode and the second electrode, an interval between electrodes in the dummy area may be greater than that between electrodes in the pad area.

In the at least one of the first electrode and the second electrode, a width in the dummy area may be greater than that in the pad area.

In the at least one of the first electrode and the second electrode, a width in the dummy area may be greater than that of an upper part of a barrier rib in parallel to the first electrode or the second electrode.

In the at least one of the first electrode and the second electrode, a width in the dummy area may be 1.5 to 5 times a width of an upper part of a barrier rib in parallel to the first electrode or the second electrode.

The barrier rib may comprise a first barrier rib in parallel to the first electrode and the second electrode and a second barrier rib intersecting the first barrier rib, and a width of the outermost first barrier rib of the first barrier ribs may be about 5 to 20 times widths of the other first barrier ribs.

The first electrode and the second electrode may be disposed in an order of the first electrode, the first electrode, the second electrode, and the second electrode.

An active barrier rib of the barrier ribs may be disposed in the active area, a dummy barrier rib of the barrier ribs may be disposed in the dummy area, and a barrier rib may not be arranged in the pad area.

In another aspect, a plasma display panel comprises: a front substrate in which a first electrode and a second electrode in parallel to each other are disposed; a rear substrate in which a third electrode intersecting the first electrode and the second electrode is disposed; and a barrier rib disposed between the front substrate and the rear substrate and for partitioning a discharge cell, wherein each of the first electrode and the second electrode comprises a plurality of line portions intersecting the third electrode in an active area, two or more line portions of the second electrode in a dummy area at the outer side of the active area are combined into one, and in a pad area at the outer side of the dummy area, two or more second electrodes are combined into one and two or more line portions of the first electrode are combined into one.

The two second electrodes may be adjacently disposed and the two adjacently disposed second electrodes may be combined into one in the pad area.

The first electrode and the second electrode may be one layer.

The at least one of the first electrode and the second electrode may comprise at least one protruded portion protruded from the line portion.

The protruded portion may comprise a portion having a curvature.

In the dummy area and the pad area, any one of the first electrode and the second electrode may be omitted.

ADVANTAGEOUS EFFECTS

In a plasma display panel of this document, a driving efficiency can be improved by advancing a structure of at least one of a first electrode and a second electrode in a dummy area or a pad area.

BRIEF DESCRIPTION OF THE DRAWINGS

FIG. 1 is a perspective view illustrating a structure of a plasma display panel in an implementation of this document;

FIG. 2 is a view explaining a reason why at least one of a first electrode and a second electrode has an one layer structure;

FIG. 3 is a partial perspective view illustrating an example of a structure in which a black layer is added between the first electrode or the second electrode and a front substrate;

FIG. 4 is a diagram illustrating in detail the first electrode or the second electrode;

FIG. 5 is a diagram illustrating an active area, a dummy area, and a pad area;

FIG. 6 is a diagram illustrating a structure of the first electrode or the second electrode in a dummy area and a pad area;

FIG. 7 is a diagram illustrating another structure of the first electrode or the second electrode in a dummy area and a pad area;

FIG. 8 is a diagram illustrating an advancing direction of an electrode in a pad area and a dummy area;

FIGS. 9 and 10 are diagrams illustrating in detail an area A of FIG. 8;

FIG. 11 is a diagram illustrating in detail a barrier rib; and

FIG. 12 is a diagram illustrating an image frame for embodying a gray level of an image in a plasma display panel in an implementation of this document.

MODE FOR THE INVENTION

FIG. 1 is a perspective view illustrating a structure of a plasma display panel in an implementation of this document.

Referring to FIG. 1, the plasma display panel comprises a front substrate 101 in which a first electrode 102 (Y) and a second electrode 103 (Z) in parallel to each other are disposed and a rear substrate 111 in which a third electrode 113 (X) intersecting the first electrode 102 (Y) and the second electrode 103 (Z) is disposed.

At least one of the first electrode 102 (Y) and the second electrode 103 (Z) may be one layer. For example, at least one of the first electrode 102 (Y) and the second electrode 103 (Z) may be a bus electrode in which a transparent electrode is omitted (ITO-Less).

At least one of the first electrode 102 (Y) and the second electrode 103 (Z) may comprise a metal material having electrical conductivity and in which is substantially opaque. For example, at least one of the first electrode 102 (Y) and the second electrode 103 (Z) may comprise a material having excellent electrical conductivity such as silver (Ag), copper (Cu), and aluminum (Al) and cheaper than a transparent material, for example indium-tin-oxide (ITO).

In an upper part of the first electrode 102 (Y) and the second electrode 103 (Z), an upper dielectric layer 104 for limiting a discharge current of the first electrode 102 (Y) and the second electrode 103 (Z) and for insulating the first electrode 102 (Y) and the second electrode 103 (Z) from each other is disposed.

A protective layer 105 for facilitating a discharge condition is disposed on the upper dielectric layer 104. The protective layer 105 may comprise a material having a high secondary electron emission coefficient, for example a magnesium oxide (MgO).

In the rear substrate 111, an electrode, for example the third electrode 113 (X) is disposed, and in an upper part of the third electrode 113 (X), a lower dielectric layer 115 for insulating the third electrode 113 (X) is disposed.

Further, in an upper part of the lower dielectric layer 115, a barrier rib 112 of a stripe type, a well type, a delta type, and a hive type for partitioning a discharge space i.e. a discharge cell is disposed.

In the plasma display panel in an implementation of this document, widths of a red color (R) discharge cell, a green color (G) discharge cell, and a blue color (B) discharge cell may be substantially equal, however a width of at least one of the red color (R) discharge cell, the green color (G) discharge cell, and the blue color (B) discharge cell may be different from widths of the other discharge cells.

For example, a width of the red color (R) discharge cell may be smallest, and widths of the green color (G) discharge cell and the blue color (B) discharge cell may be greater than a width of the red color (R) discharge cell. A width of the green color (G) discharge cell may be substantially equal to or different from that of the blue color (B) discharge cell. Accordingly, a color temperature characteristic of an embodied image can be improved.

A predetermined discharge gas is filled within a discharge cell partitioned by the barrier rib 112.

Further, when an address discharge is generated, a phosphor layer 114, for example, a red color (R) phosphor layer, a green color (G) phosphor layer, and a blue color (B) phosphor layer for emitting visible light for displaying an image is disposed within the discharge cell partitioned by the barrier rib 112.

Further, a thickness of the phosphor layer 114 in at least one of the red color (R) discharge cell, the green color (G) discharge cell, and the blue color (B) discharge cell may be different from that of the phosphor layer 114 in the other discharge cells. For example, a thickness of the blue color (B) phosphor layer may be thicker than that of a phosphor layer in the red color (R) discharge cell i.e. the red color (R) phosphor layer. A thickness of the green color (G) phosphor layer may be substantially equal to or different from that of the blue color (B) phosphor layer.

Further, in the above-described description, only a case in which each of the upper dielectric layer 104 and the lower dielectric layer 115 is one layer is described, however at least one of the upper dielectric layer 104 and the lower dielectric layer 115 may be formed in a plurality of layers.

FIG. 2(*a*) shows an example of a case in which the first electrode 210 and the second electrode 220 disposed in the front substrate 200 are formed in a plurality of layers. For example, it is assumed that the first electrode 210 and the second electrode 220 comprise transparent electrodes (210*a*, 220*a*) and bus electrodes (210*b*, 220*b*).

In the case of FIG. 2(*a*), in a process of forming the first electrode 210 and the second electrode 220, after transparent electrodes (210*a*, 220*a*) are formed, the bus electrodes (210*b*, 220*b*) should be formed again.

Accordingly, the case of FIG. 2(*a*) has more manufacturing processes than a case where the first electrode and the second electrode have an one layer structure, thereby increasing a manufacturing cost.

Further, the transparent electrodes (210*a*, 220*a*) of FIG. 2(*a*) may comprise a material such as a substantially transparent material, for example indium-tin-oxide (ITO). Because a transparent material such as the indium-tin-oxide (ITO) is relatively expensive, a manufacturing cost can be more increased.

When the first electrode 102 and the second electrode 103 are formed in one layer, as in FIG. 2(*b*), a manufacturing process may become simple and a material such as relatively expensive indium-tin-oxide (ITO) may not be used, whereby a manufacturing cost can be reduced.

Referring to FIG. 3, black layers (300*a*, 300*b*) for preventing discoloration of the front substrate 101 and having a degree of the darkness higher than that of at least one of the first electrode 102 and the second electrode 103 may be disposed between an electrode disposed at the front substrate 101 i.e. at least one of the first electrode 102 and the second electrode 103 and the first substrate 101.

For example, when the front substrate 101 directly contacts with the first electrode 102 or the second electrode 103, a migration phenomenon in which a predetermined area of the front substrate 101 that directly contacts with the first electrode 102 or the second electrode 103 is discolored may be generated, and the black layers (300*a*, 300*b*) prevent a direct contact between the front substrate 101 and the first electrode 102 or the second electrode, thereby preventing a migration phenomenon.

If the black layers (300*a*, 300*b*) are provided between the front substrate 101 and the first electrode 102 or the second electrode 103, even if the first electrode 102 and the second electrode 103 are made of a material having a high reflectivity, generation of reflected light can be prevented.

FIG. 4 is a diagram illustrating in detail the first electrode or the second electrode.

Referring to FIG. 4, at least one of the first electrode 430 and the second electrode 460 may comprise a plurality of line portions (410*a*, 410*b*, 440*a*, and 440*b*) intersecting the third electrode 470.

The line portions (410*a*, 410*b*, 440*a*, and 440*b*) can intersect the third electrode 470 within a discharge cell partitioned by the barrier rib 400.

Each of the line portions (410*a*, 410*b*, 440*a*, and 440*b*) can be disposed apart a pre-determined distance within the discharge cell.

For example, the first line portion 410*a* and the second line portion 410*b* of the first electrode 430 may be disposed apart an interval d1, and the first line portion 440*a* and the second line portion 440*b* of the second electrode 460 may be disposed apart an interval d2. Here, the intervals d1 and d2 may be equal or different.

Further, the line portions (410*a*, 410*b*, 440*a*, and 440*b*) have a predetermined width. For example, the first line portion 410*a* of the first electrode 430 may have a width Wa, and the second line portion 410*b* may have a width Wb. Here, the widths Wa and Wb may be equal and different.

Further, shapes of the first electrode 430 and the second electrode 460 may be symmetrical or asymmetrical to each other within the discharge cell. For example, the first electrode 430 may comprise three line portions, and the second electrode 460 may comprise two line portions.

Further, the number of the line portions may be also adjusted. For example, the first electrode 430 or the second electrode 460 may comprise four or five line portions.

Further, at least one of the first electrode 430 and the second electrode 460 may comprise at least one protruded portion (420*a*, 420*b*, 420*d*, 450*a*, 450*b*, and 450*d*).

The protruded portions (420*a*, 420*b*, 420*d*, 450*a*, 450*b*, and 450*d*) are protruded from the line portions (410*a*, 410*b*, 440*a*, and 440*b*). Further, the protruded portions (420*a*, 420*b*, 420*d*, 450*a*, 450*b*, and 450*d*) may be parallel to the third electrode 470.

At least one of a plurality of protruded portions (420*a*, 420*b*, 420*d*, 450*a*, 450*b*, and 450*d*) is protruded from the line portions (410*a*, 410*b*, 440*a*, and 440*b*) in the first direction, and at least one of a plurality of protruded portions (420*a*, 420*b*, 420*d*, 450*a*, 450*b*, and 450*d*) is protruded from the line portions (410*a*, 410*b*, 440*a*, and 440*b*) in a second direction different from the first direction.

For example, the first protruded portions (420*a*, 420*b*) of the first electrode 430 is protruded from the first line portion 410*a* of the first electrode 430 in the first direction, for example in a central direction of the discharge cell, and the second protruded portion 420*d* of the first electrode 430 can be protruded from the second line portion 410*b* of the first electrode 430 in a second direction, for example in a direction opposite to the first direction.

The first protruded portions (420*a*, 420*b*, 450*a*, and 450*b*) among the protruded portions (420*a*, 420*b*, 420*d*, 450*a*, 450*b*, and 450*d*) enable an interval g1 between the first electrode 430 and the second electrode 460 in a portion in which the first protruded portions (420*a*, 420*b*, 450*a*, and 450*b*) are formed to be smaller than an interval g2 in other portions within the discharge cell partitioned by the barrier rib 400. Accordingly, a discharge firing voltage i.e. a discharge voltage generating between the first electrode 430 and the second electrode 460 can be lowered.

Further, the second protruded portions (420*d*, 450*d*) protruded in the second direction enable a discharge to be diffused to the rear side of a discharge cell.

A length of at least one of a plurality of protruded portions (420*a*, 420*b*, 420*d*, 450*a*, 450*b*, and 450*d*) may be different from lengths of other protruded portions. For example, a length of the first protruded portions (420*a*, 420*b*) of the first electrode 430 is L1, and a length of the second protruded portion 420*d* may be L2, which is different from L1.

As in FIG. 4, at least one protruded portion (420*a*, 420*b*, 420*d*, 450*a*, 450*b*, and 450*d*) may comprise a portion having a curvature. When formed in this way, a manufacturing process of the first electrode 430 and the second electrode 460 can be easily performed. Further, upon driven, it can be prevented wall charges from being excessively concentrated at a specific position, whereby a discharge characteristic can be stabilized and driving stability can be improved.

For example, when a protruded portion is formed in a quadrangular form, upon driven, most of wall charges may be excessively concentrated in a degree that may not be controlled at a corner portion of a protruded portion. Accordingly, the corner portion of the protruded portion may be electrically damaged or the control of a discharge may be relatively difficult.

When at least one protruded portions (420*a*, 420*b*, 420*d*, 450*a*, 450*b*, and 450*d*) comprises a portion having a curvature, as in FIG. 4, upon driven, wall charges may not be excessively concentrated at a specific portion but be evenly distributed over entire protruded portions (420*a*, 420*b*, 420*d*, 450*a*, 450*b*, and 450*d*). Accordingly, the protruded portions (420*a*, 420*b*, 420*d*, 450*a*, 450*b*, and 450*d*) can be protected from electrical damage. Further, because a generation time point of a discharge can be adjusted, the control of a discharge can be easily performed.

FIG. 4 shows a case where each of the first electrode 430 and the second electrode 460 comprises three protruded portions, however each of the first electrode 430 and the second electrode 460 may comprise four protruded portions or two protruded portions. The number of protruded portions can be variously adjusted.

Further, connection portions (420*c*, 450*c*) for connecting at least two of a plurality of line portions (410*a*, 410*b*, 440*a*, and 440*b*) may be provided.

For example, the connection portion 420*c* of the first electrode 430 connects the first line portion 410*a* and the second line portion 410*b* of the first electrode 430, and the connection portion 450*c* of the second electrode 460 connects the first line portion 440*a* and the second line portion 440*b* of the second electrode 460.

When the connection portions (420*c*, 450*c*) connect two line portions (410*a*, 410*b*, 440*a*, and 440*b*), upon driven, a discharge generating between the first protruded portions (420*a*, 420*b*) of the first electrode 430 and the second protruded portions (450*a*, 450*b*) of the second electrode 460 can be more easily diffused toward the second line portion 410*b* of the first electrode 430 and the second line portion 440*b* of the second electrode 460 through the connection portion 420*c* of the first electrode 430 and the connection portion 450*c* of the second electrode 460.

FIG. 5 is a diagram illustrating an active area, a dummy area, and a pad area.

Referring to FIG. 5, the plasma display panel comprises an active area 500 in which an image is displayed and a dummy area 510 and a pad area 520 that do not contribute to the display of an image. The active area 500 is an area in which predetermined visible rays are generated and in which an image is displayed, upon driven.

The dummy area 510 can be disposed at the outer side of the active area 500. The dummy area 510 can be formed to secure structural stability of the active area 500 or to secure driving stability in the active area.

Within a discharge cell formed in the dummy area 5101 i.e. within a dummy discharge cell, a phosphor layer may not be formed, or at least one of the first electrode, the second electrode, and the third electrode may not be formed.

The pad area 520 is disposed at the outer side of the dummy area 510. The pad area 520 can be electrically connected to an external driver. Further, a part of the pad area 520 can be exposed to electrically connect to an external driver.

FIG. 6 is a diagram illustrating a structure of the first electrode or the second electrode in a dummy area and a pad area.

Referring to FIG. 6, in the dummy area, two or more line portions of at least one of the first electrode 102 and the second electrode 103 are combined into one.

For example, as in FIG. 6, in the active area, when each of the first electrode 102 and the second electrode 103 comprises two line portions, in the dummy area, two line portions of the second electrode 103 may be combined into one.

Further, only one of the first electrode 102 and the second electrode 103 is disposed in the dummy area and the remaining one may be omitted. For example, as in FIG. 6, only the second electrode 103 is disposed in the dummy area and the first electrode 102 may be omitted. In this way, when only one of the first electrode 102 and the second electrode 103 is disposed in the dummy area, generation of a discharge can be prevented in the dummy area and thus a quality of an image displayed in the plasma display panel can be improved. Further, although not shown in FIG. 6, in an opposite pad area, only the first electrode 102 is disposed and the second electrode 103 may be omitted.

Further, in the pad area at the outer side of the dummy area, two or more electrodes of at least one of the first electrode 102 and the second electrode 103 are combined into one. For example, as in FIG. 6, in the pad area, two second electrodes 103 may be combined into one.

The second electrode 103 in which two or more electrodes are combined into one in the pad area is an electrode to which a ramp-up signal and a ramp-down signal are not supplied in a reset period of a subfield to be described later or to which a scan signal is not supplied in an address period and to which a sustain signal is supplied in a sustain period.

When two or more line portions are combined into one in the dummy area, an entire electrical resistance value can be reduced and thus a driving efficiency can be improved.

Further, when two or more second electrodes 103 are combined into one in the pad area, an entire electrical resistance value can be further reduced and thus a driving efficiency can be further improved.

Further, at least two first electrodes 102 can be adjacently disposed, and at least two second electrodes 103 may be adjacently disposed. For example, the first electrode 102 and the second electrode 103 can be disposed in an order of the first electrode 102, the first electrode 102, the second electrode 103, and the second electrode 103. When disposed in this way, upon driven, a coupling effect between adjacent electrodes can be weakened and an effect of lowering an entire capacitance value can be obtained.

FIG. 7 is a diagram illustrating another structure of the first electrode or the second electrode in a dummy area and a pad area.

Referring to FIG. 7, when each of the first electrode 102 and the second electrode 103 comprises two line portions in the active area, the second electrode 103 may be omitted in the dummy area and two line portions of the first electrode 102 may be extended up to the pad area. In the pad area, two line portions of the first electrode 102 may be combined into one.

When a plurality of line portions of the first electrode 102 is extended in the dummy area and two or more line portions of the first electrode 102 are combined into one in the pad area, as in FIG. 6, an electrical resistance value of the first electrode 102 is reduced, thereby improving a driving efficiency.

FIG. 8 is a diagram illustrating an advancing direction of an electrode in a pad area and a dummy area.

Referring to FIG. 8, an advancing direction in the dummy area of two or more electrodes of at least one of the first electrode and the second electrode can be substantially equal to an advancing direction in the pad area.

An electrode in which an advancing direction in the dummy area and an advancing direction in the pad area are substantially equal may be an electrode disposed at a dummy discharge cell line 800 in parallel to a line portion.

For example, as in FIG. 8, an advancing direction of at least two outermost second electrodes may be substantially equal in the dummy area and the pad area.

Further, an advancing direction in the dummy area of one or more electrode of at least one of the first electrode and the second electrode may be different from an advancing direction in the pad area thereof. For example, as in FIG. 8, an advancing direction of the second electrode disposed in the active area is different from that in the dummy area and the pad area.

The reason why an advancing direction in the pad area of the second electrode disposed in the active area is different from an advancing direction in the dummy area thereof is that the second electrodes should be gathered within a predetermined area to be more easily electrically connected to an external driver in the pad area.

Further, the dummy area is an area that does not contribute to the display of an image, and the second electrode disposed at the dummy discharge cell line 800 is not required to be connected to the external driver or is not required to supply a driving signal even if the second electrode is connected to the external driver, whereby an advancing direction in the pad area of the second electrode may be different from that of other second electrodes disposed in the active area.

When the second electrode changes an advancing direction in the pad area in order to advance in a direction different from an advancing direction in the dummy area, an inductance value and an entire length of the second electrode can be increased. However, when the second electrode in the pad area advances in the same direction as an advancing direction in the dummy area, an inductance value and an entire length of the second electrode may be smallest and it is advantageous in electricity.

Further, the second electrode disposed at the dummy discharge cell line 800 may be grounded. Accordingly, generation of a discharge can be effectively suppressed in the dummy discharge cell line 800.

In FIG. 8, only the dummy area and the pad area corresponding to the second electrode are described, however the dummy area and the pad area corresponding to the first electrode at the opposite side may have the same structure as that of FIG. 8.

FIGS. 9 and 10 are diagrams illustrating in detail an area A of FIG. 8.

First, referring to FIG. 9, the second electrode 103*a* and the second electrode 103*b* are combined into one in the pad area at the outer side of the dummy area, and the second electrode 103*c* and the second electrode 103*d* are extended and advanced in a direction different from the dummy area in the pad area. The second electrodes 103*a* and 103*b* are second electrodes disposed at the dummy discharge cell line, and the second electrodes 103*c* and 103*d* are second electrodes disposed at the active area.

Further, in at least one of the first electrode 102 and the second electrodes (103*a*, 103*b*, 103*c*, and 130*d*), an interval between electrodes in the dummy area may be greater than that between electrodes in the pad area.

In more detail, when a portion in which two line portions are combined into one is called a first portion, an interval between first portions of the second electrodes 103*c* and 103*d* may be G1 in the dummy area and may be G2 smaller than G1 in the pad area. When formed in this way, as an interval between the second electrodes becomes narrow at an end part of the pad area, the second electrode and an external driver can be more easily connected.

Further, in at least one of the first electrode 102 and the second electrodes (103*a*, 103*b*, 103*c*, and 103*d*), a width in the dummy area is greater than that in the pad area. For example, a width of the first portion in the dummy area of the second electrode 103*c* or 103*d* may be 'a', and a width of the first portion in the pad area thereof may be 'b' smaller than 'a'.

When a width (b) of the first portions of the second electrodes 103*c* and 103*d* in the pad area is greater than or equal to a width (a) of the first portions in the dummy area, in a pad area in which an interval between the first portions of the second electrodes 103*c* and 103*d* becomes narrow, the first portions of the second electrodes 103*c* and 103*d* may be electrically short-circuited. Accordingly, it is preferable that the width (b) in the pad area of the first portion of the second electrode 103*c* or 103*d* is smaller than the width (a) in the dummy area thereof.

Further, when the width (a) of the first portion in the dummy area of at least one of the first electrode 102 and the second electrodes (103*a*, 103*b*, 103*c*, and 103*d*) is excessively small, entire electrical resistance increases and thus a driving efficiency may be deteriorated. When the width (a) of the first portion in the dummy area of at least one of the first electrode 102 and the second electrodes (103*a*, 103*b*, 103*c*, and 103*d*) is excessively great, a possibility that the first portions of two adjacent electrodes, for example the second electrodes 103*c* and 103*d* are electrically short-circuited excessively increases.

In consideration of this, it is preferable that the width of the first portion in the dummy area is 1.5 to 5 times the width (C) of the barrier rib 112 in parallel to the first electrode 102 or the second electrodes (103*a*, 103*b*, 103*c*, and 103*d*). For example, the width (a) of the first portion of the second electrode 103*c* may be 1.5 to 5 times the width (C) of the barrier rib 112.

The width of the barrier rib 112 may be a width (C) of an upper part of the barrier rib 112, as in FIG. 10.

Further, in an intersecting direction of the first electrode 102 or the second electrode 103, a width of the first portion of at least one of the first electrode 102 and the second electrode 103 may be greater than the sum of widths of the combined line portions.

For example, when it is assumed that three line portions are combined into one and a width of each line portion is W1 in an intersecting direction of the first electrode 102 or the second electrode 103, a width of the first portion in which three line portions are combined is greater than 3W1.

FIG. 11 is a diagram illustrating in detail a barrier rib.

Referring to FIG. 11, the barrier rib 112 comprises a first barrier rib 112*b* in parallel to the first electrode (not shown) and the second electrode (not shown) and a second barrier rib 112*a* intersecting the first barrier rib 112*b*, and a width C1 of the outermost first barrier rib 112*b* of the first barrier ribs 112*b* may be greater than a width C2 of other first barrier ribs 112*b*.

For example, the width C1 of the outermost first barrier rib 112*b* of the first barrier ribs 112*b* is 5 to 20 times the width C2 of the other first barrier ribs 112*b*. When formed in this way, structural stability of the plasma display panel can be fully secured.

FIG. 12 is a diagram illustrating an image frame for embodying a gray level of an image in a plasma display panel in an implementation of this document.

Referring to FIG. 12, the image frame for embodying a gray level of an image in the plasma display panel can be divided into a plurality of subfields having the different number of times of light emitting.

At least one of the plurality of subfields can be divided into a reset period for initializing a discharge cell, an address period for selecting a discharge cell to be discharged, and a sustain period for embodying a gray level.

By adjusting the number of a sustain signal to be supplied in a sustain period, a gray level weight of the corresponding subfield can be set. That is, a predetermined gray level weight can be given to each subfield using a sustain period. By adjusting the number of a sustain signal to be supplied in a sustain period of each subfield according to a gray level weight in each subfield, a gray level of various images can be embodied.

Further, in FIG. 12, subfields are arranged in one image frame in an increasing order of a gray level weight, however subfields may be arranged in one image frame in a decreasing order of a gray level weight.

The invention claimed is:

1. A plasma display panel comprising:

a front substrate in which a first electrode and a second electrode in parallel to each other are disposed;

a rear substrate in which a third electrode intersecting the first electrode and the second electrode is disposed; and a barrier rib for partitioning a discharge cell between the front substrate and the rear substrate, wherein at least one of the first electrode and the second electrode comprises a plurality of line portions intersecting the third electrode in an active area, and two or more line portions of at least one of the first electrode and the second electrode are combined into one in a dummy area at an outer side of the active area, wherein in a pad area at the outer side of the dummy area, two or more electrodes of at least one of the first electrode and the second electrode are combined into one.

2. The plasma display panel of claim 1, wherein the at least one of the first electrode and the second electrode is a bus electrode.

3. The plasma display panel of claim 1, wherein the at least one of the first electrode and the second electrode comprises at least one protruded portion protruded from the line portion.

4. The plasma display panel of claim 1, wherein in the dummy area, any one of the first electrode and the second electrode is omitted.

5. The plasma display panel of claim 1, wherein an advancing direction in the dummy area of two or more electrodes of at least one of the first electrode and the second electrode is substantially equal to an advancing direction in a pad area at the outer side of the dummy area.

6. The plasma display panel of claim 1, wherein when a portion in which the two or more line portions are combined is called a first portion, an advancing direction in the dummy area of the first portion of the at least one of the first electrode and the second electrode is different from an advancing direction in a pad area.

7. The plasma display panel of claim 6, wherein an interval between two first portions in the dummy area of the at least one of the first electrode and the second electrode is greater than an interval between two first portions in the pad area.

8. The plasma display panel of claim 6, wherein a width of a first portion in the dummy area of the at least one of the first electrode and the second electrode is greater than a width of a first portion in the pad area.

9. The plasma display panel of claim 1, wherein a width of a first portion in the dummy area of the at least one of the first electrode and the second electrode is greater than a width of an upper part of a barrier rib in parallel to the first electrode or the second electrode.

10. The plasma display panel of claim 9, wherein a width of a first portion of the at least one of the first electrode and the second electrode in the dummy area is 1.5 to 5 times the width of the upper part of the barrier rib in parallel to the first electrode or the second electrode.

11. The plasma display panel of claim 1, wherein the barrier rib comprises a first barrier rib in parallel to the first electrode and the second electrode and a second barrier rib intersecting the first barrier rib, and a width of an outermost first barrier rib of the first barrier ribs is about 5 to 20 times widths of other first barrier ribs.

12. The plasma display panel of claim 1, wherein the first electrode and the second electrode are disposed in an order of the first electrode, the first electrode, the second electrode, and the second electrode.

13. The plasma display panel of claim 1, wherein an active barrier rib of the barrier ribs is disposed in the active area, a dummy barrier rib of the barrier ribs is disposed in the dummy area, and a barrier rib is not disposed in the pad area.

14. A plasma display panel comprising:

a front substrate in which a first electrode and a second electrode in parallel to each other are disposed;

a rear substrate in which a third electrode intersecting the first electrode and the second electrode is disposed; and a barrier rib for partitioning a discharge cell between the front substrate and the rear substrate, wherein each of the first electrode and the second electrode comprises a plurality of line portions intersecting the third electrode in an active area, two or more line portions of the second electrode in a dummy area at an outer side of the active area are combined into one, and two or more second electrodes in a pad area at an outer side of the dummy area are combined into one, and two or more line portions of the first electrode are combined into one.

15. The plasma display panel of claim 14, wherein the two or more second electrodes are adjacently disposed and the two adjacently disposed second electrodes are combined into one in the pad area.

16. The plasma display panel of claim 14, wherein at least one of the first electrode and the second electrode is a bus electrode.

17. The plasma display panel of claim 14, wherein at least one of the first electrode and the second electrode comprises at least one protruded portion protruded from the line portion.

18. The plasma display panel of claim 17, wherein the at least one protruded portion comprises a portion having a curvature.

19. The plasma display panel of claim 14, wherein in the dummy area and the pad area, any one of the first electrode and the second electrode is omitted.

* * * * *